US007694483B1

(12) United States Patent
Tucker

(10) Patent No.: US 7,694,483 B1
(45) Date of Patent: Apr. 13, 2010

(54) MODULAR STRUCTURE FROM PREFABRICATED SYNTHETIC COMPONENT ELEMENTS

(76) Inventor: Christopher David Tucker, 10309 Carrick La., Oklahoma City, OK (US) 73162

( * ) Notice: Subject to any disclaimer, the term of this patent is extended or adjusted under 35 U.S.C. 154(b) by 750 days.

(21) Appl. No.: 11/652,251

(22) Filed: Jan. 11, 2007

(51) Int. Cl.
*E04C 2/34* (2006.01)

(52) U.S. Cl. ..... 52/481.1; 52/281; 52/280; 52/482; 52/92.2

(58) Field of Classification Search ..... 52/92.2, 52/92.3, 481.1, 481.2, 483.1, 281, 264, 280, 52/482
See application file for complete search history.

(56) References Cited

U.S. PATENT DOCUMENTS 1,562,784 A * 11/1925 Olsen ..... 52/714
2,966,708 A * 1/1961 Freeman Jr. ..... 52/696
3,332,188 A * 7/1967 Schaefer ..... 52/349
3,680,271 A * 8/1972 Satchell ..... 52/656.1
3,845,601 A * 11/1974 Kostecky ..... 52/290
3,885,367 A * 5/1975 Thunberg ..... 52/204.1
4,262,047 A * 4/1981 Barnett et al. ..... 428/73
4,809,476 A * 3/1989 Satchell ..... 52/241
4,878,323 A * 11/1989 Nelson ..... 52/92.2
5,274,973 A * 1/1994 Liang ..... 52/243
5,642,594 A 7/1997 Sucre F
5,930,968 A 8/1999 Pullam
6,092,340 A * 7/2000 Simmons ..... 52/92.1
6,295,778 B1 10/2001 Burt
6,412,233 B1 * 7/2002 Jones ..... 52/92.2
6,412,249 B1 * 7/2002 Boyer et al. ..... 52/481.1
6,807,776 B2 10/2004 Girdwood
7,216,465 B2 * 5/2007 Saldana ..... 52/655.1
7,310,914 B1 * 12/2007 Moore ..... 52/92.2

* cited by examiner

*Primary Examiner*—Brian E Glessner
*Assistant Examiner*—Adriana Figueroa
(74) *Attorney, Agent, or Firm*—Randal D. Homburg

(57) ABSTRACT

A modular structure assembled with different prefabricated and measured interlocking component elements made from a light-weight synthetic material. The component elements, including vertical stud members, horizontal support members, wall truss support members, rafter members, slip connector members, corner connector members, and a center truss support member, are assembled in an interlocking manner with optional secondary fastening components for further securing of the elements together upon assembly where local building codes require such secondary fastening. The component elements are resistant to weather, rot and insect destruction and the assembly of the modular structure does not require tools or labor required in the assembly of structures using conventional building materials or lumber.

11 Claims, 15 Drawing Sheets

MODULAR STRUCTURE FROM PREFABRICATED SYNTHETIC COMPONENT ELEMENTS

CROSS REFERENCE TO RELATED APPLICATIONS

None

I. BACKGROUND OF THE INVENTION

1. Field of Invention

A modular structure assembled with different prefabricated and measured interlocking component elements made from a light-weight synthetic material. The component elements are assembled in an interlocking manner with optional secondary fastening components for further securing of the elements together upon assembly where local building codes require such secondary fastening. The component elements are resistant to weather, rot and insect destruction and the assembly of the modular structure does not require tools or labor required in the assembly of structures using conventional building materials or lumber.

2. Description of Prior Art

The following United States patents were discovered and are disclosed within this application for utility patent. All relate to prefabricated building components.

In U.S. Pat. No. 5,930,968 to Pullam, a wall framing system is disclosed having upper and lower beams and several studs secured to the beams using a securing system incorporating a perpendicular flange or tongue received within slots in the upper and lower beams at predetermined locations. The studs snap into the upper and lower beams using this securing means. A similar component structure is disclosed in U.S. Pat. No. 5,642,594 to Sucre F, which incorporates several structural panels and frames shaped and designed for direct interconnection by locking pins, panels and screws.

Also, U.S. Pat. No. 5,930,968 to Pullam, uses a channel for the studs to be inset and held in place using a peg system and utilizes pre-drilled holes for wiring insertion within the studs. It also uses and I-beam stud configuration which does not possess the same characteristics and the lumber dimensional configuration of the present invention studs or other components with the honeycomb core. U.S. Pat. No. 6,253,530 to Price discloses honeycomb core features within large component panels. In U.S. Pat. No. 5,247,773 to Weir, large preformed wall panels attaching horizontally are disclosed, but without the vertical support disclosed by the present invention component structural support framework.

II. SUMMARY OF THE INVENTION

Conventional buildings have been using lumber which has been the standard in the building industry for centuries. In the past years, lightweight metal products have been used providing enhanced safety and reducing the weight of the overall structure. In more recent years, synthetic products for building have been provided, including plastics, for prefabricated structures, as seen in the prior art. Several different types of synthetic materials forming simple assembled structures are also disclosed in prior art. However, the present building structure and its components provide an assembled building structure in which each component may be assembled to provide an interlocking structural support frame with square corners which may be modified for custom structures or standard prefabricated structures without requiring tools or knowledge as to building techniques.

The primary objective of the invention is to provide a structure formed of synthetic light-weight components which may be assembled without modification of the components to form a complete assembled structure. A second feature is to provide the structure with light-weight and weather resistant components which form a sturdy structure with each component being connected by interlocking each component using easy and quick assembly means.

III. DESCRIPTION OF THE DRAWINGS

The following drawings are submitted with this utility patent application.

IV. DESCRIPTION OF THE PREFERRED EMBODIMENT

Figure 14:
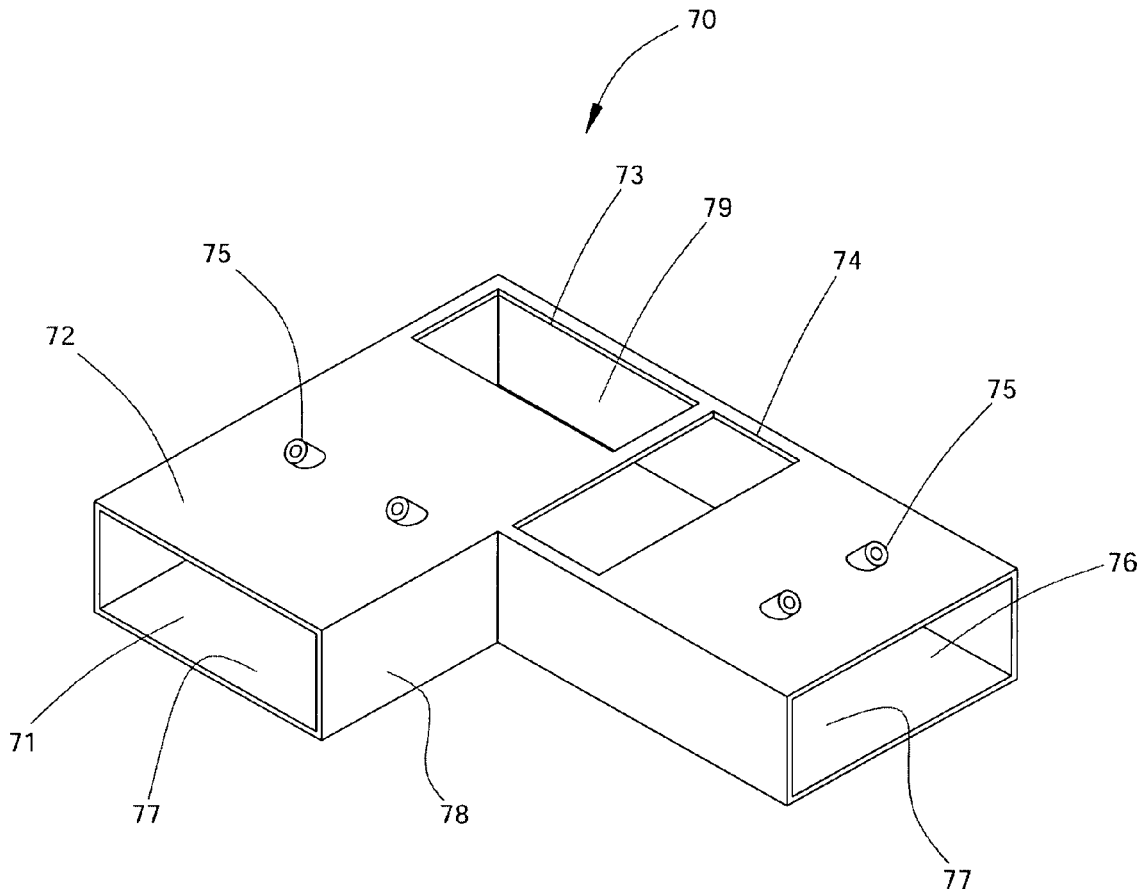
FIG. 14 is a perspective view of the corner connector member.
Figure 15:
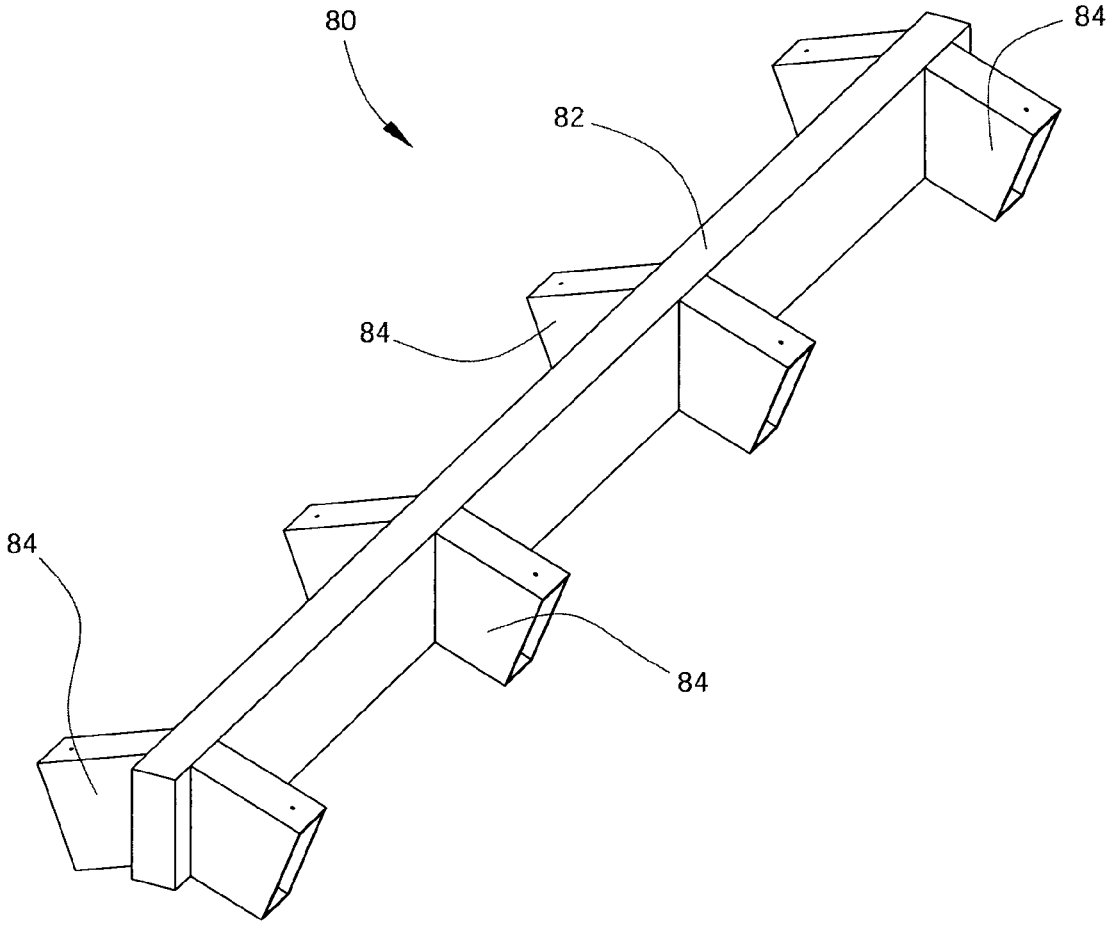
FIG. 15 is a perspective view of a center truss support member.

A modular structure 10 with pre-fabricated and measured synthetic component elements for use in the construction of small or moderate enclosed structures, shown in FIGS. 1-16B of the drawings, the modular structure 10 comprising a plurality of horizontal support members 30 as upper headers and lower footers for the structure 10, each horizontal support member 30 having multiple stud insertion slots 32, a plurality of vertical stud members 20 inserted with a stud insertion slot 32 in the horizontal support members 30, the vertical stud members 20 retained within the stud insertion slots 32 by at least one internal locking tab 33 within the stud insertion slots 32 engaging transverse attaching slots 22, 24 on the vertical stud members 20, connecting the vertical stud members 20 between the horizontal support members 30 forming walls of the modular structure 10, a plurality of wall truss support members 40 attached to the upper horizontal support members 30 supporting first ends 52 of rafter members 50, each rafter member 50 having a second end 54 attached to a center truss support member 80, FIG. 15, the rafter members 50, center truss support member 80 and wall truss support members 40 forming a roof and ceiling of the modular structure 10, one or more slip connector members 60 attaching one or more vertical stud members 20 along horizontal support members 30 at locations where no stud insertion slot 32 is located or providing brace support between vertical stud members 20, a plurality of corner connector members 70 providing attachment between assembled horizontal support members 30 and vertical stud members 20 forming walls of the modular structure 10 at fixed angles, each corner connector 70 member also providing for the attachment of vertical stud members 20 for additional corner support, the modular structure 10 providing the structural support for paneling, doors and windows to further attach to form a weather resistant, insect resistant and rot resistant structure.

Figure 6A:
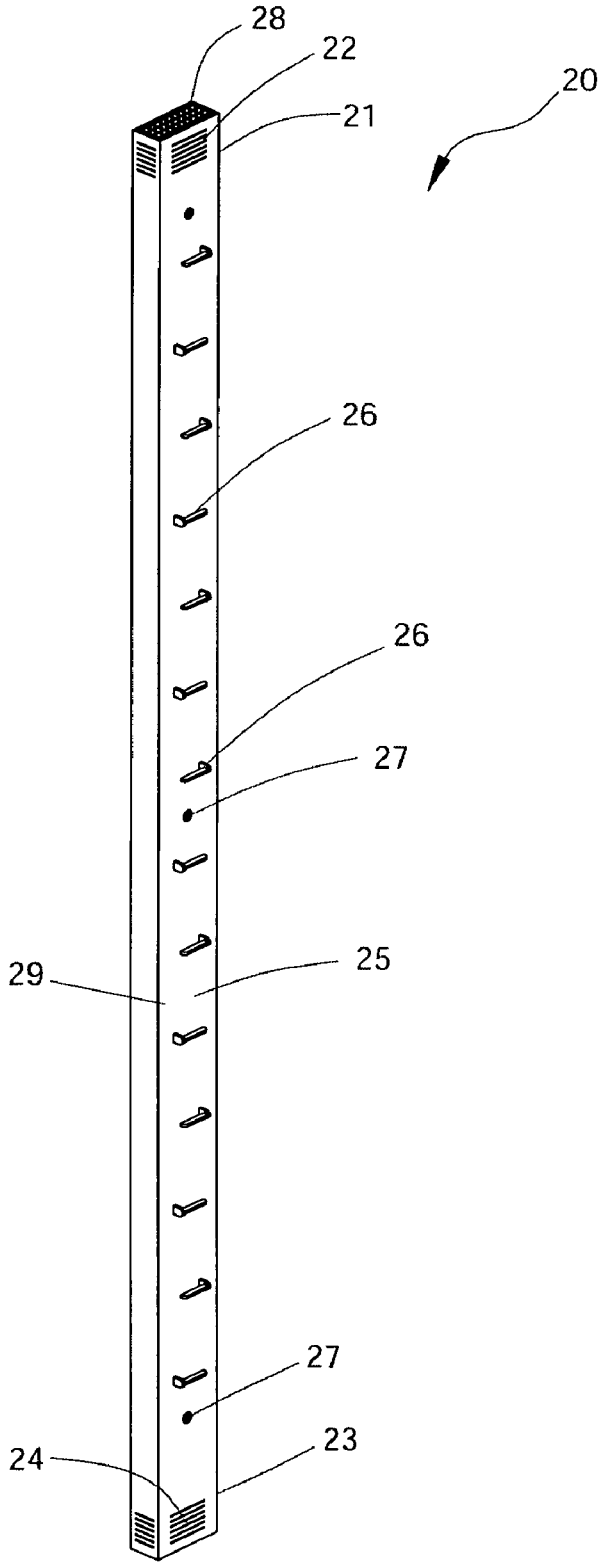
FIG. 6A is a perspective view of the stud member.
Figure 6B:
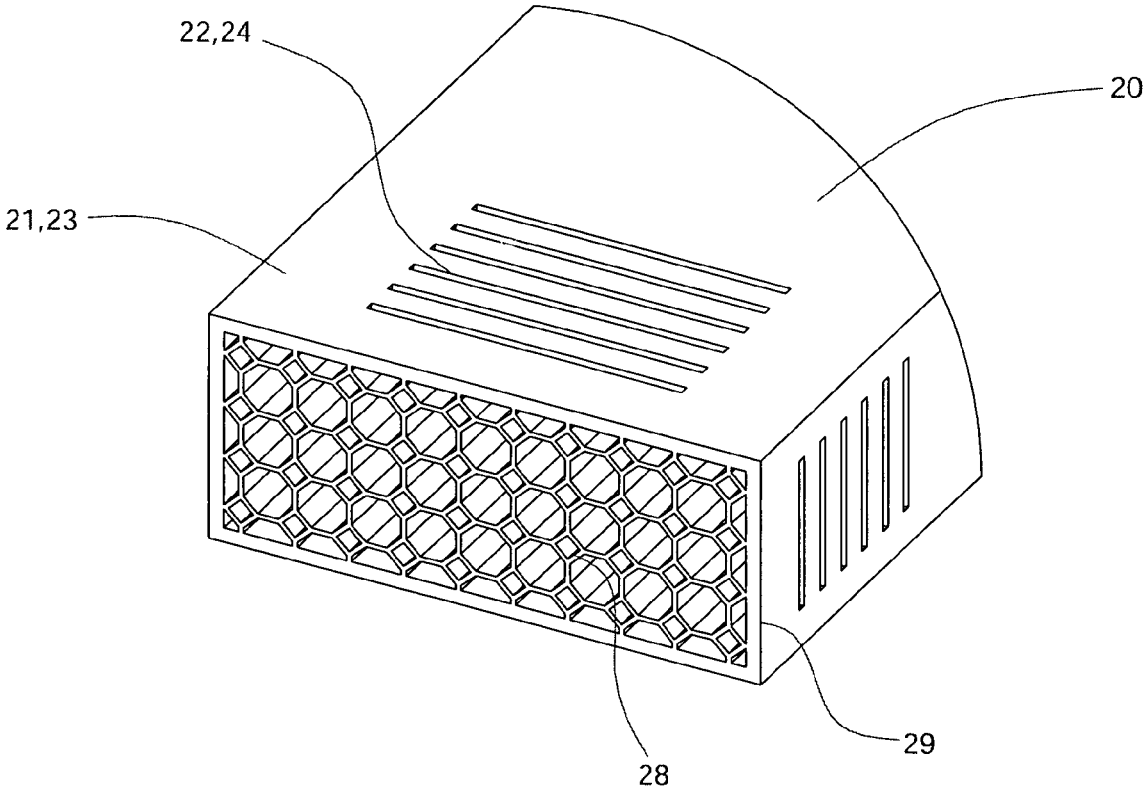
FIG. 6B is an end view of the stud member indicating the honeycomb core of the stud member.
Figure 7A:
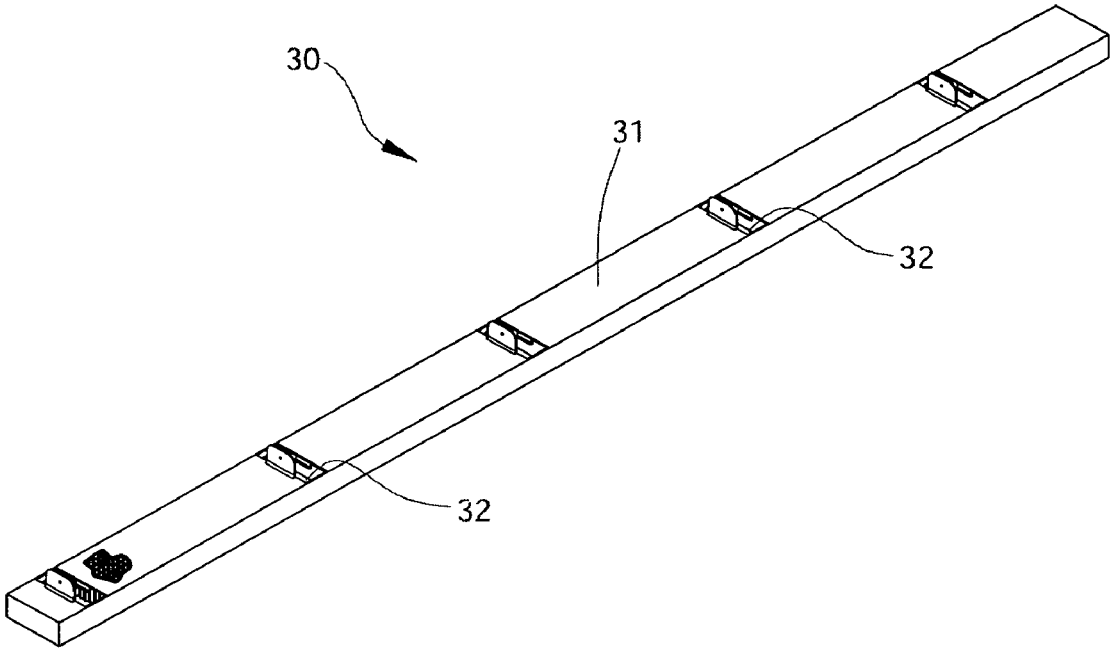
FIG. 7A is a perspective view of the footer member and/or header member.
Figure 7B:
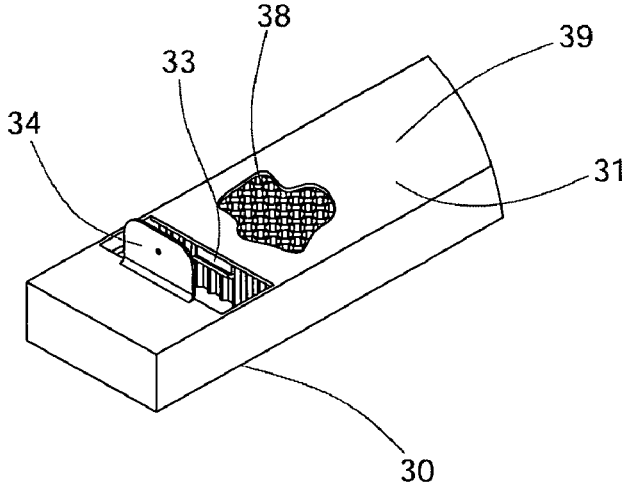
FIG. 7B is an isolated view of FIG. 7A showing a view of a stud member slot and revealing the honeycomb core of the footer member or header member.
Figure 8:
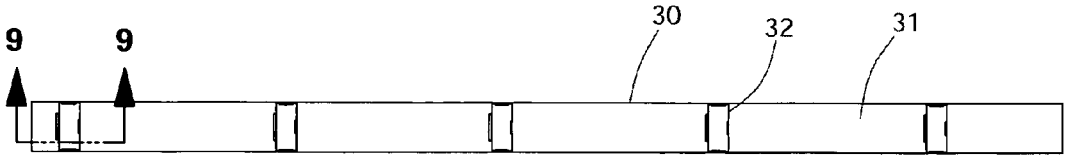
FIG. 8 is a top view of the footer member and/or header member.
Figure 9:
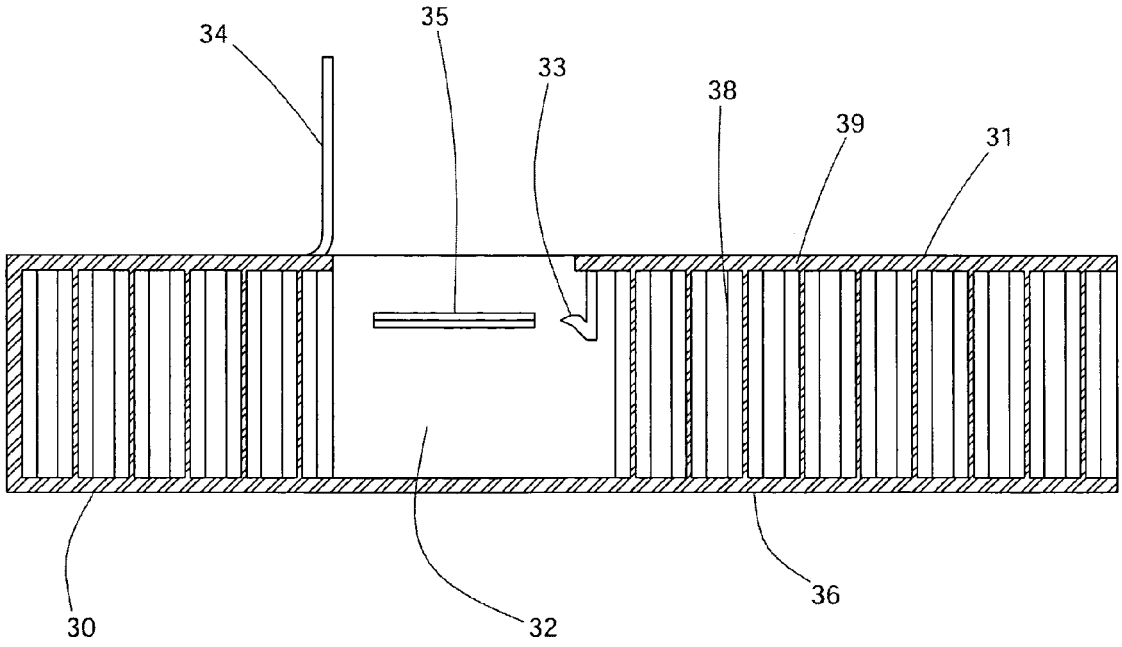
FIG. 9 is a side cross-sectional view of the stud member slot along section lines 9/9 of FIG. 8.

Each vertical stud member 20, shown in FIGS. 6A and 6B, is further disclosed as having a first end 21 providing a plurality of transverse attaching slots 22, a second end 23 also providing a plurality of transverse attaching slots 24, side portions 25 having a multiplicity of flexible connector clips 26 between the first and second ends 21, 23, at least one transverse bore 27 through the side portions 25 allowing for a passage of conduit, wire or pipes, each vertical stud member 20 having a synthetic outer surface 29 and a honeycomb core 28 to provide structural integrity to each vertical stud member 20. It is also contemplated that some of the vertical stud members 20 may have the transverse attaching slot 22, 24 along the entire side portions 25 of the vertical stud member 20, not shown in the drawings, to allow for these vertical stud members 20 to be cut to a smaller length, yet still be inserted within a stud insertion slot 32 to be retained by the at least one internal locking tab 33 within the stud insertion slot 32. The insertion of a vertical stud member 20 into a stud insertion slot 32 in a horizontal support member 30 may be disengaged by the application of a putty knife between the stud insertion slot 32 and the inserted first or second end 21, 23 of the vertical stud member 20, disengaging the at least one internal locking tab 33, allowing withdrawal of the vertical stud member 20 from the stud insertion slot 32.

Each horizontal support member 30, shown in FIGS. 7A, 7B, 8 and 9, further comprises a first side portion 31 with the multiple stud insertion slots 32 defined therein, adapted to receive the first or second end 21, 23 of a vertical stud member 20. Each stud insertion slot 32 further provides the at least one internal locking tab 33, FIG. 9, engaging at least one of the transverse attaching slots 22, 24 on the first or second end 21, 23 of each vertical stud member 20, retaining the vertical stud member 20 within each stud insertion slot 32 along with at least one internal side support tab 35, FIG. 3. In addition, an external screw tab 34 is provided adjacent to each stud insertion slot 32 to further attach each vertical stud member 20 to each horizontal support member 30 with a screw, if need or required. A second side portion 36 is also provided on each horizontal support member 30, the second side portion 36 being smooth and flat. The horizontal support member 30 also has a synthetic outer surface 39 and a honeycomb core 38 to provide structural integrity to each horizontal support member 30.

Figure 1:
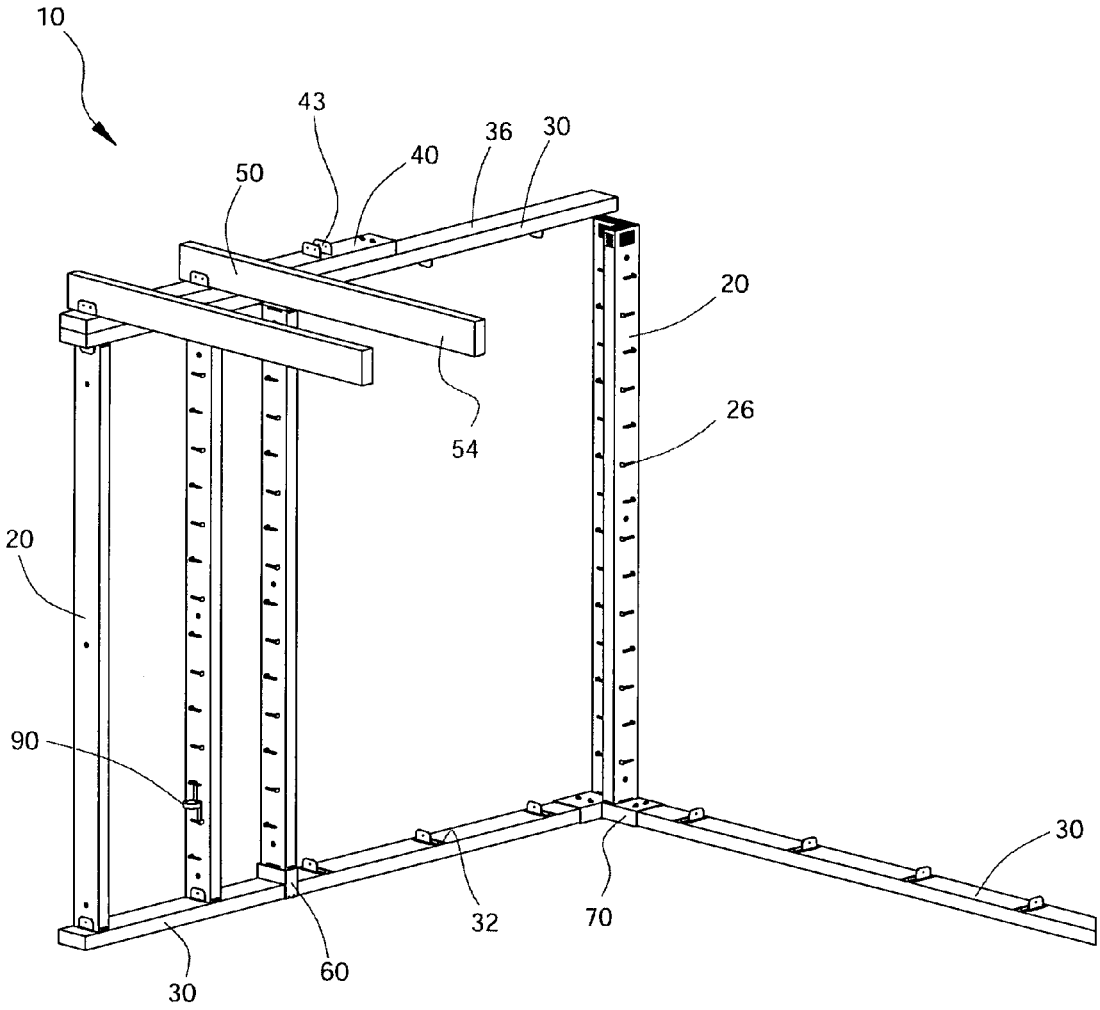
FIG. 1 is a perspective drawing of a partially assembled structure using different prefabricated and measured interlocking component elements made from a light-weight synthetic material.
Figure 2:
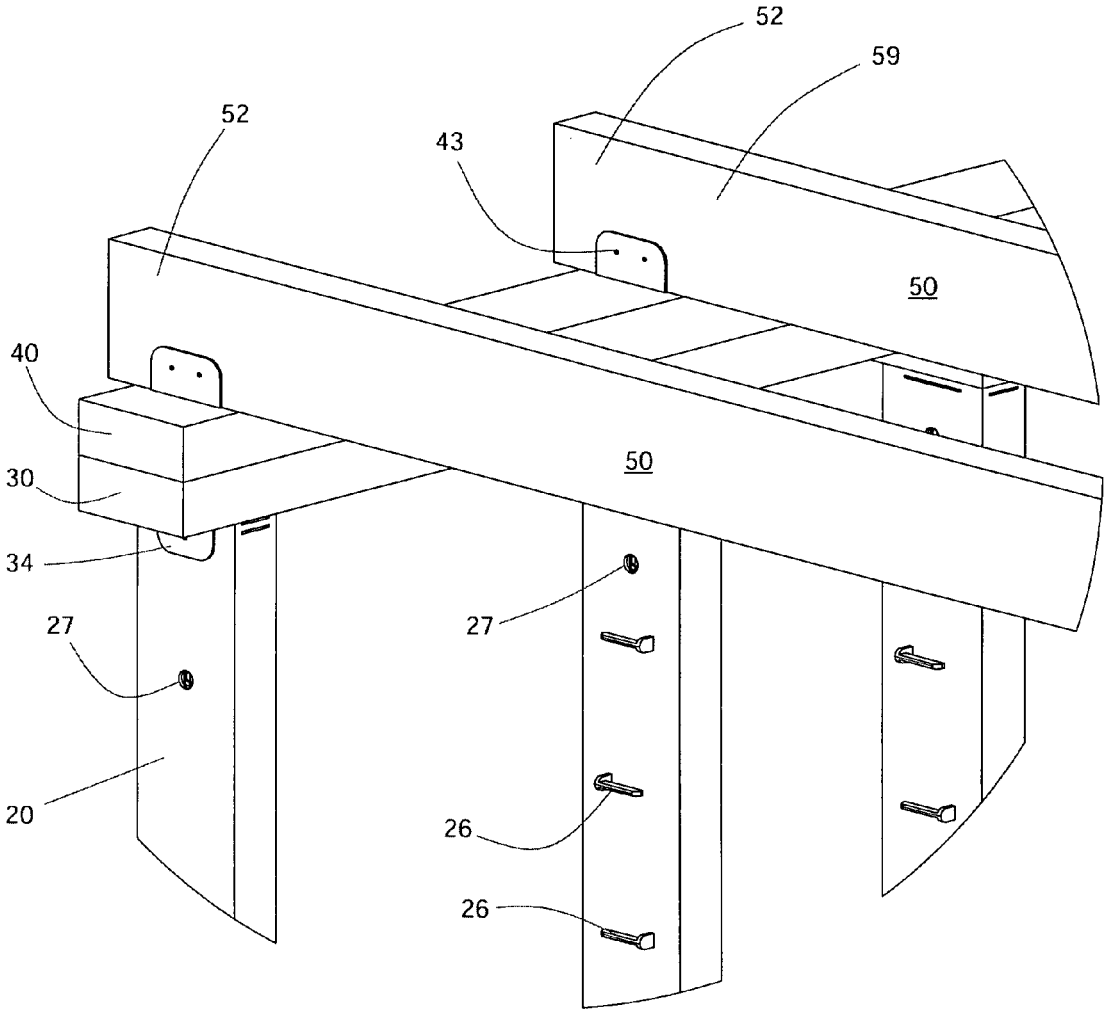
FIG. 2 is an isolated view of FIG. 1 of the assembled structure showing a wall truss support member, rafters, a header member, and three stud members.
Figure 10:
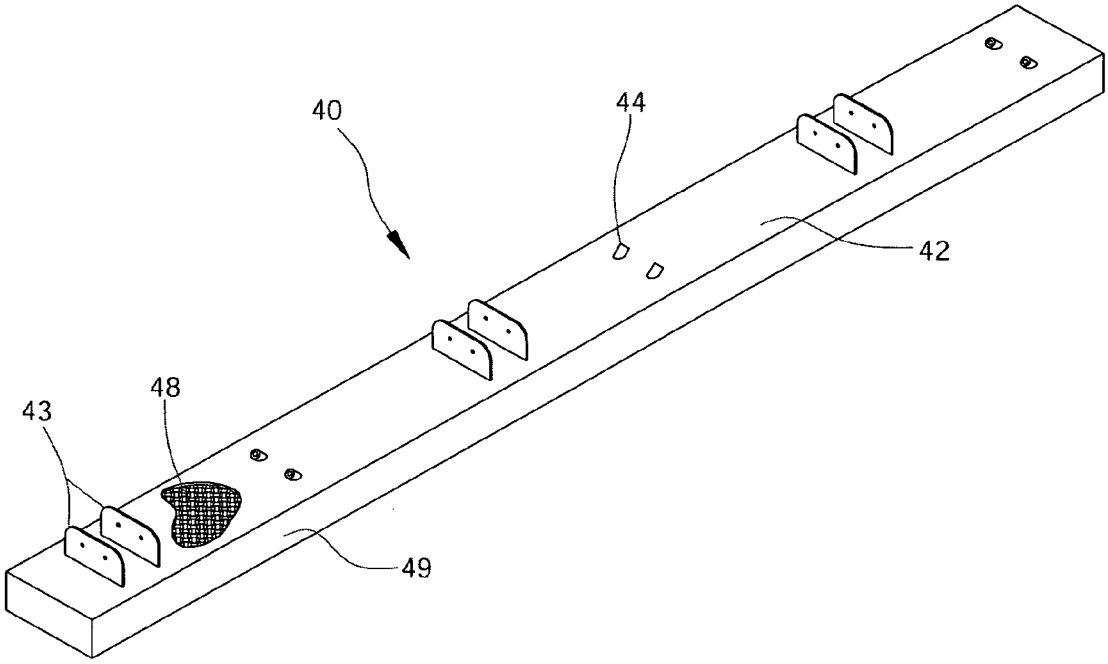
FIG. 10 is an upper perspective view of the truss support member.
Figure 11:
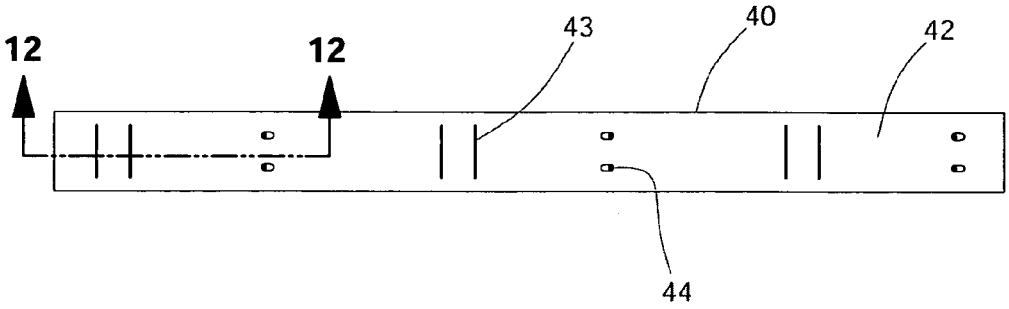
FIG. 11 is a top view of the truss support member.
Figure 12:
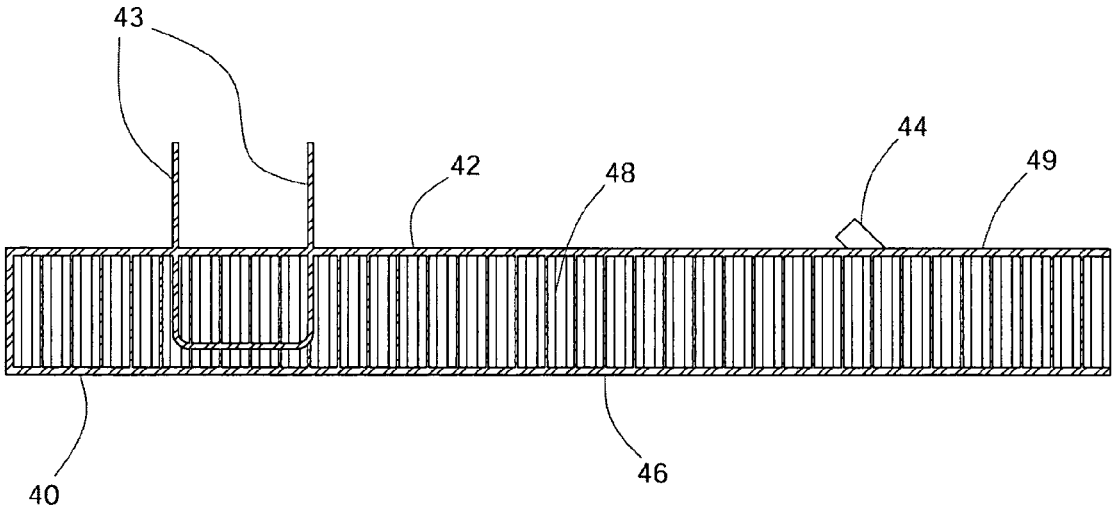
FIG. 12 is a side cross-sectional view of the truss support member along section lines 12/12 of FIG. 11.

Each wall truss support member 40, FIGS. 10, 11 and 12, is further defined as having a first side portion 42 along which a plurality of paired extending rafter anchor tabs 43 are placed, each pair of rafter anchor tabs 43 spaced apart to receive the first end of a rafter member 52, FIG. 2, each pair of the anchor tabs 43 attached to each first end 52 of each rafter member 50 set within. Angled screw apertures 44 in the first side portion 42 provide a location wherein screws may be attached to affix the wall truss support members 40 to horizontal support members 30, as shown in FIGS. 1 and 2 of the drawings, the actual screws not shown. The wall truss support member 40 also has a smooth and flat second side portion 46, a synthetic outer surface 49 and a honeycomb core 48 to provide structural integrity to each wall truss support member 40.

Figure 13:
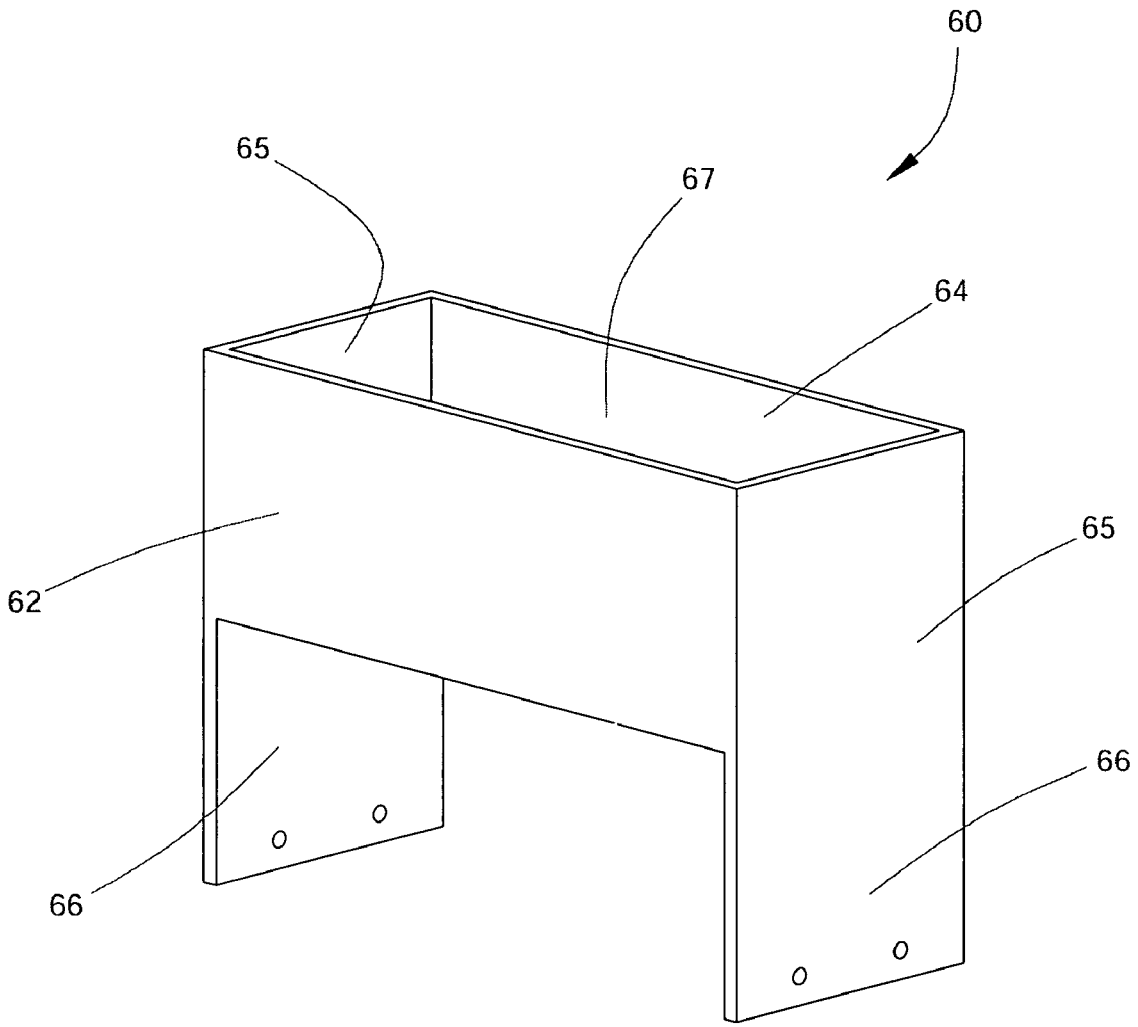
FIG. 13 is a perspective view of the slip connector member.

Each slip connector member 60, FIG. 13, further comprises a front portion 62, a rear portion 64, and two side portions 65 defining a stud channel 67 adapted to receive a first or second end 21, 23 of a vertical stud member 20, each side portion 65 further defining an extending side flange 66 extending beyond the stud channel 67. These slip connector members 60 are provided to allow for the affixation of a vertical stud member 20 along a horizontal support member 30 at a location where there is no stud insertion slot 32, FIG. 4, the side flanges 66 connecting along any portion of the horizontal support member 30, or connecting one vertical stud member 20 to another vertical stud member 20.

Figure 5:
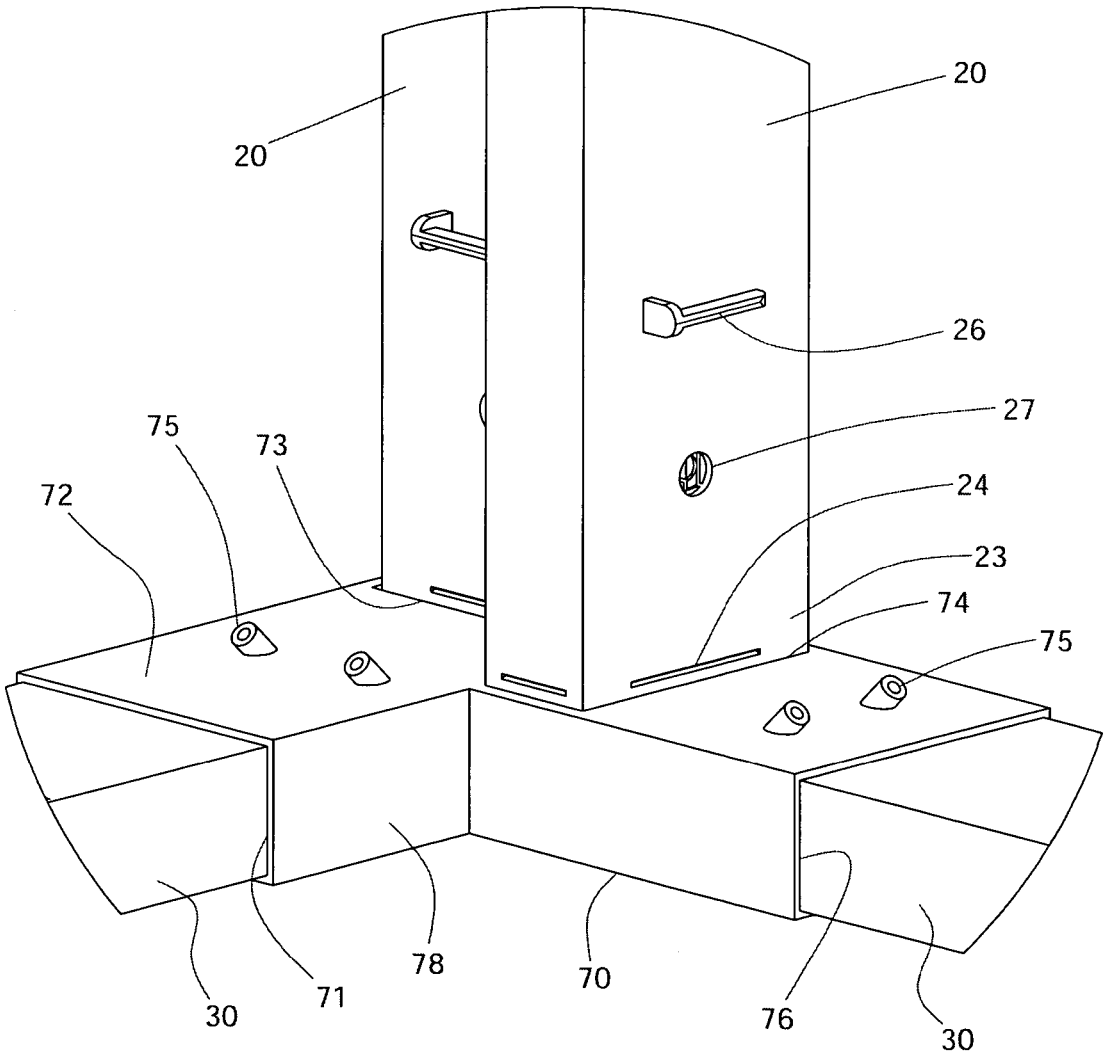
FIG. 5 is an isolated view of FIG. 1 of the assemble structure with a corner connector member connecting two footer members at a ninety degree angle, the corner connector member further connecting two stud members at a corner of the assembled structure.

The corner connector member 70, FIG. 14, further comprises an upper plate 72, a lower plate 77, an inner angled side plate 78 and an outer angled side plate 79 defining a first horizontal support channel 71 adapter to receive a horizontal support member 30, a second horizontal support channel 76 adapted to receive a second horizontal support member 30, the upper plate 72 further defining a first stud slot 73, a second stud slot 74 and angled screw apertures 75, each corner connector member 70 retaining the horizontal support members 30 attached therein at a defined angle, as shown in FIGS. 5 and 14 to be at right angles, and also to retain vertical stud members 20 inserted with the first and second stud slots 73, 74 perpendicular with each other and also at right angles to the horizontal support members 30 attached within the first and second horizontal support channels 71, 76. While these corner connector members 70 are shown at ninety degree or right angles in the drawings, it is contemplated that other angles may be provided in other embodiments of the corner connector members 70 that would place the horizontal support members 30 at angles other than ninety degrees, including 30 degree angles, 45 degree angles, 60 degree angles, or anywhere between 10 and 80 degrees. The angled screw apertures 75 are provided to allow for screws to be inserted to attach the horizontal support members 30 within the corner connector member 70, shown in FIG. 5, the actual screws not shown in this drawing.

Figure 3:
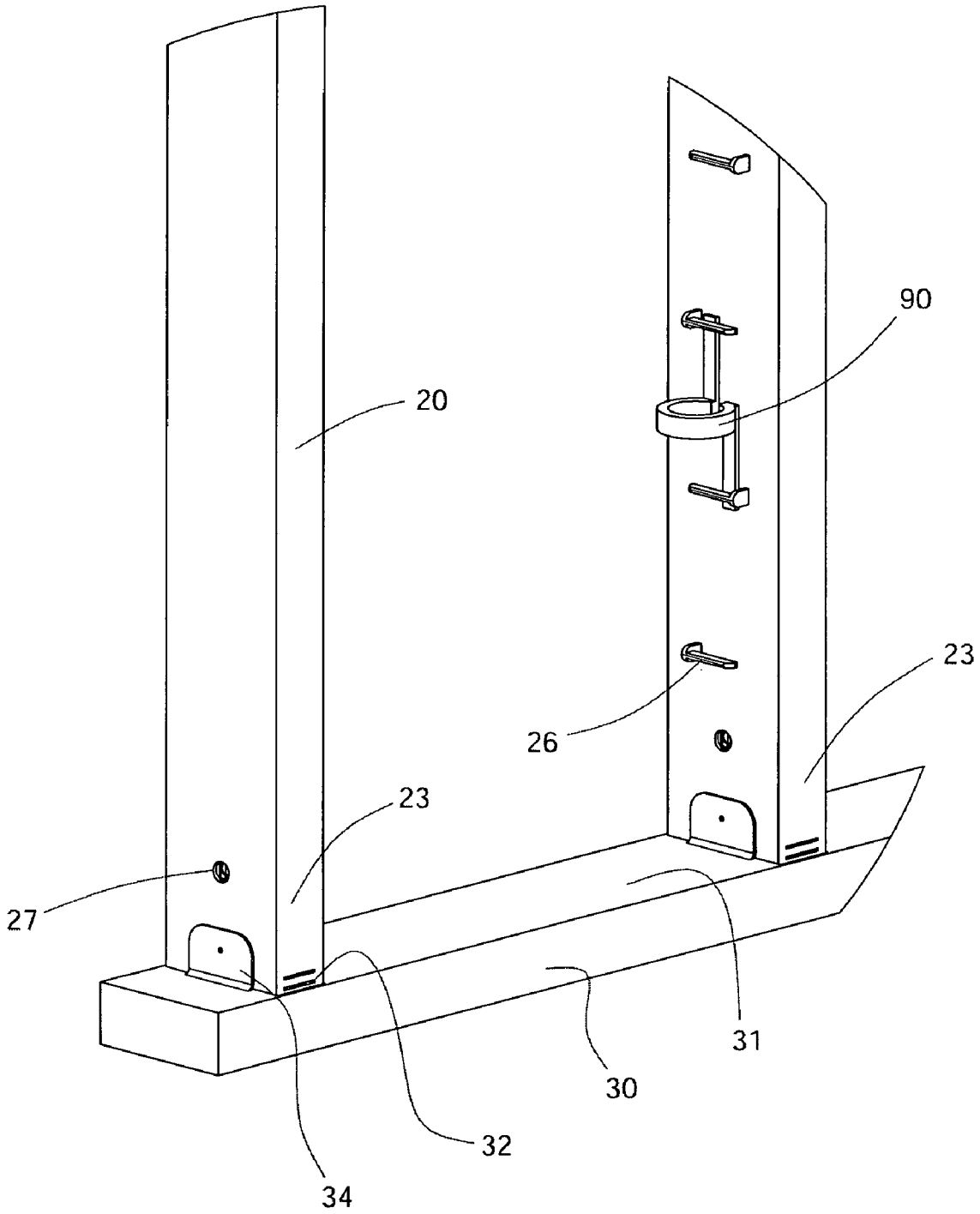
FIG. 3 is an isolated view of FIG. 1 of the assembled structure showing two stud members attached to a footer member.
Figure 4:
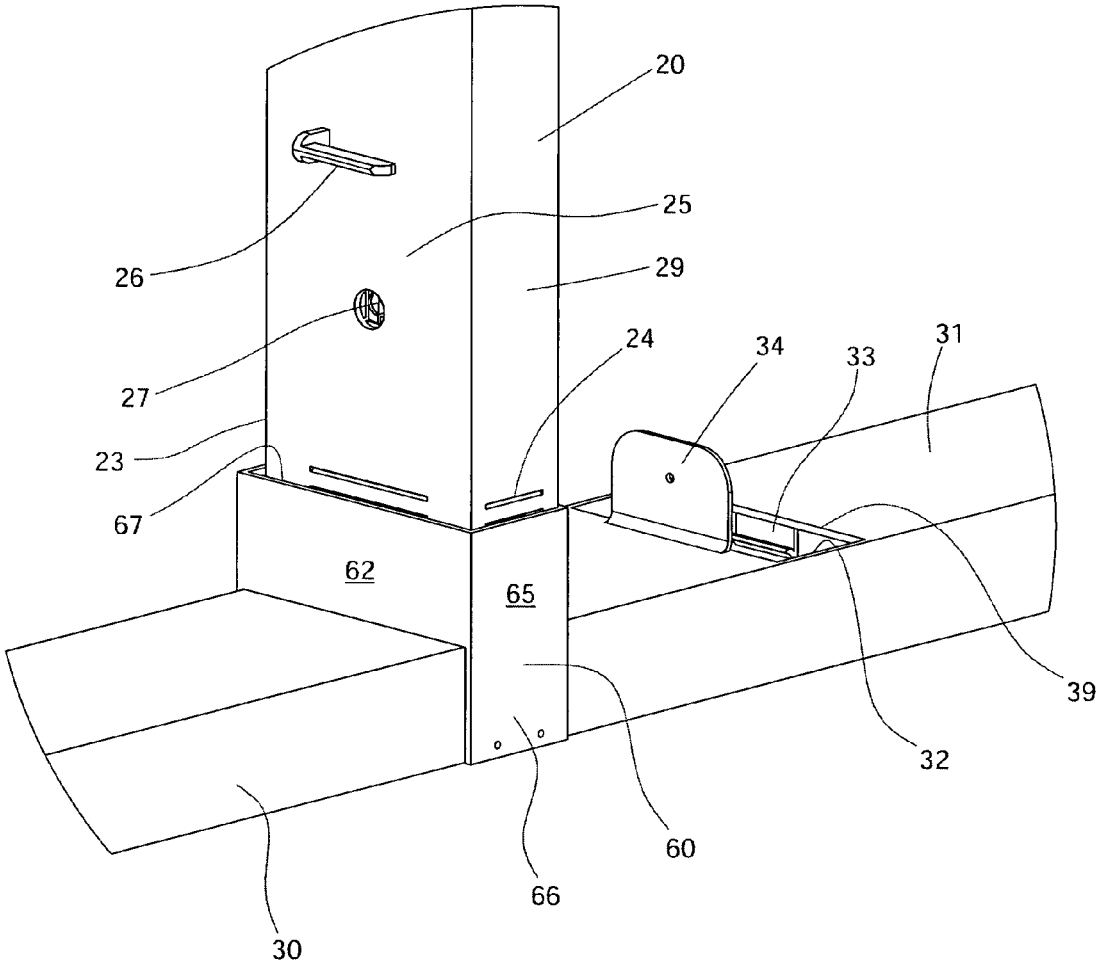
FIG. 4 is an isolated view of FIG. 1 of the assembled structure showing a stud member attached to a footer member by a slip connector member.
Figure 16A:
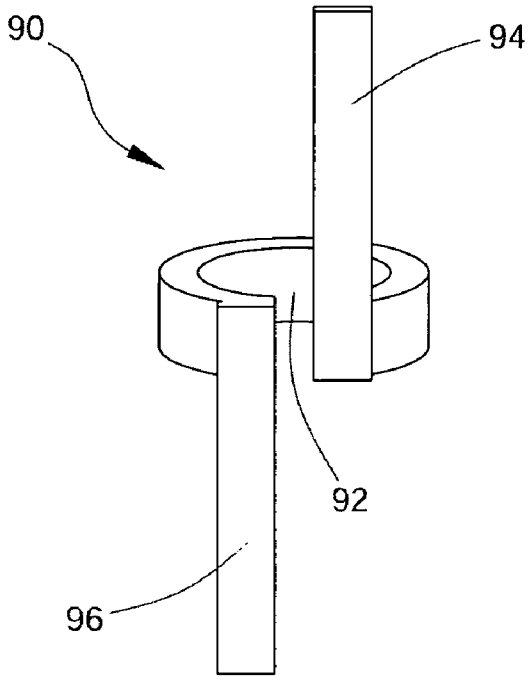
FIG. 16A is a rear view of a conduit connector member.
Figure 16B:
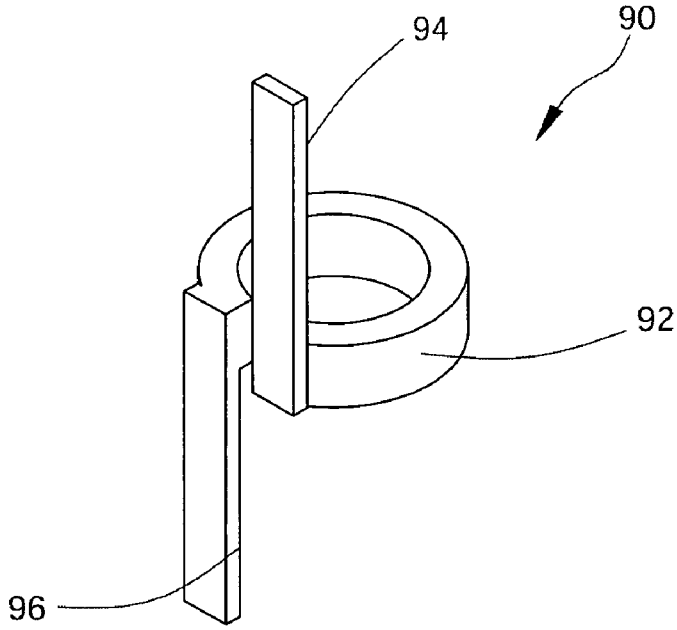
FIG. 16B is a side view of the conduit connector member.

Conduit connectors 90, shown in FIGS. 16A and 16B of the drawings are provided to retain electrical conduit, not shown, against vertical stud members 20 where needed, as indicated in FIGS. 1 and 3 of the drawings, each conduit connector 90 further defining a conduit ring 92 having an upward extending first ring support 94 and a lower extending second ring support 96, the conduit ring 92 adapted to slidingly receive a conduit, not shown, and further to place the first and second ring supports 94, 96 in adjacent connector clips 26 along side portions 25 of the vertical stud members 20. These conduit connector members 90 may also be adapted to receive electrical wiring or plumbing pipes, although not shown in the drawing figures.

Once assemble as the modular structure 10, paneling of the user's choice may be attached to the outer walls, inner walls and roof formed by the vertical stud members 20, horizontal stud members 30, corner connector members 70, wall truss support members 40, rafter members 50 and center truss support members 80, and insulation may be placed between the vertical stud members 20 and rafter members 50 forming a weather resistant and complete sealed structure. Where needed, the horizontal support members 30 and vertical stud members 20 may be cut in the same manner as conventional lumber for door frames, window frames and custom features, the cut ends of these vertical and horizontal support members 20, 30 being attached to other structural components by the slip connector members 60, or other conventional fastening means, including but not limited to adhesives, screws, nuts and bolts or connecting straps.

While the invention has been particularly shown and described with reference to a preferred embodiment thereof, it will be understood by those skilled in the art that changes in form and detail may be made therein without departing from the spirit and scope of the invention.

What is claimed is:

1. A modular structure with pre-fabricated and measured synthetic component elements for use in the construction of small or moderate enclosed structures, said modular structure comprising: a plurality of horizontal support members having a honeycomb core to provide structural integrity to each said horizontal support member, each said horizontal support member having a multiplicity of stud insertion slots, a plurality of vertical stud members, each vertical stud member inserted within a one of said stud insertion slots in said horizontal support members, said vertical stud members retained within said stud insertion slots by at least one internal locking tab within said stud insertion slots engaging transverse attaching slots on said vertical stud members connecting said vertical stud members between said horizontal support members and with at least one internal side support tab within said stud insertion slots further retaining said vertical stud member within said stud insertion slot;

a plurality of wall truss support members attached to said upper horizontal support members supporting first ends of rafter members, each said rafter member having a second end attached to a center truss support member;

at least one slip connector members attaching one or more said vertical stud members along said horizontal support members at locations along said horizontal support member where there is no said stud insertion slot and providing support between said vertical stud members; and a plurality of corner connector members providing attachment between assembled horizontal support members and vertical stud members at fixed angles, each said corner connector member also providing attachment of said vertical stud members for additional corner support, said modular structure resistant to weather, insect infestation and rot.

2. The modular structure as disclosed in claim 1, each said vertical stud member further comprising:

a first end providing a plurality of transverse attaching slots;

a second end also providing a plurality of transverse attaching slots;

side portions having a multiplicity of flexible connector clips between said first and second ends, at least one transverse bore through said side portions, each said vertical stud member having a synthetic outer surface and a honeycomb core to provide structural integrity to each said vertical stud member.

3. The modular structure as disclosed in claim 1, each said horizontal support member further comprising: a first side portion defining said multiple stud insertion slots adapted to receive a first or second end of said vertical stud member, each stud insertion slot further providing the at least one internal locking tab engaging at least one of said transverse attaching slots on said first or second end of each said vertical stud member retaining said vertical stud member within each said stud insertion slot;

an external screw tab adjacent to each said stud insertion slot to further attach each said vertical stud member to each horizontal support member; a second flat and smooth side portion; and a synthetic outer surface.

4. The modular structure as disclosed in claim 1, each said wall truss support member further comprising:

a first side portion along which a plurality of paired extending rafter anchor tabs are placed, each said pair of rafter anchor tabs spaced apart to receive and attach said first end of said rafter member;

angled screw apertures in said first side portion to affix said wall truss support members to horizontal support members;

a smooth and flat second side portion;

a synthetic outer surface;

and a honeycomb core to provide structural integrity to each said wall truss support member.

5. The modular structure as disclosed in claim 1, each said slip connector member further comprising:

a front portion, a rear portion, and two side portions defining a stud channel adapted to receive a first or second end of said vertical stud member, each side portion further defining an extending side flange extending beyond said stud channel, said side flanges connecting said slip connector member to said horizontal support member, or connecting one said vertical stud member to another said vertical stud member.

6. The modular structure as disclosed in claim 1, each said corner connector member further comprising: an upper plate, a lower plate, an inner angled side plate and an outer angled side plate defining a first horizontal support channel adapted to receive a horizontal support member, a second horizontal support channel adapted to receive a second horizontal support member, said upper plate further defining a first stud slot, a second stud slot and angled screw apertures, each corner connector member retaining said horizontal support members attached therein at a defined angle, and retaining said vertical stud members inserted within each said first and second stud slots perpendicular to each other and at right angles to said horizontal support members attached within said first and second horizontal support channels.

7. A modular structure with pre-fabricated and measured synthetic component elements for use in the construction of small or moderate enclosed structures, said modular structure comprising:

a plurality of vertical stud members comprising a first end providing a plurality of transverse attaching slots, a second end providing a plurality of transverse attaching slots, side portions having a multiplicity of flexible connector clips between said first and second ends, at least one transverse bore through said side portions, a synthetic outer surface and a honeycomb core to provide structural integrity to each said vertical stud member;

a plurality of horizontal support members comprising a first side portion defining a multiplicity of stud insertion slots adapted to receive said first or second end of said vertical stud member, each stud insertion slot further providing the at least one internal locking tab engaging at least one of said transverse attaching slots on said first or second end of each said vertical stud member retaining said vertical stud member within each said stud insertion slot, at least one internal side support tab further retaining said first or second end of said vertical stud member within said stud insertion slot, an external screw tab adjacent to each said stud insertion slot to further attach each said vertical stud member to each horizontal support member, a second flat and smooth side portion, a synthetic outer surface, and a honeycomb core to provide structural integrity to each said horizontal support member;

a plurality of wall truss support members attached to said upper horizontal support members supporting first ends of rafter members, each said rafter member having a second end attached to a center truss support member;

at least one slip connector members attaching one or more said vertical stud members along said horizontal support members at locations along said horizontal support member where there is no said stud insertion slot and providing support between said vertical stud members; and a plurality of corner connector members providing attachment between assembled horizontal support members and vertical stud members at fixed angles, each said corner connector member also providing attachment of said vertical stud members for additional corner support, said modular structure resistant to weather, insect infestation and rot.

8. The modular structure as disclosed in claim 7, each said wall truss support member further comprising:

a first side portion along which a plurality of paired extending rafter anchor tabs are placed, each said pair of rafter anchor tabs spaced apart to receive and attach said first end of said rafter member;

angled screw apertures in said first side portion to affix said wall truss support members to horizontal support members;

a smooth and flat second side portion;

a synthetic outer surface;

and a honeycomb core to provide structural integrity to each said wall truss support member.

9. The modular structure as disclosed in claim 7, each said slip connector member further comprising:

a front portion, a rear portion, and two side portions defining a stud channel adapted to receive a first or second end of said vertical stud member, each side portion further defining an extending side flange extending beyond said stud channel, said side flanges connecting said slip connector member to said horizontal support member, or connecting one said vertical stud member to another said vertical stud member.

10. The modular structure as disclosed in claim 7, each said corner connector member further comprising: an upper plate, a lower plate, an inner angled side plate and an outer angled side plate defining a first horizontal support channel adapted to receive a horizontal support member, a second horizontal support channel adapted to receive a second horizontal support member, said upper plate further defining a first stud slot, a second stud slot and angled screw apertures, each corner connector member retaining said horizontal support members attached therein at a defined angle, and retaining said vertical stud members inserted within each said first and second stud slots perpendicular to each other and at right angles to said horizontal support members attached within said first and second horizontal support channels.

11. The modular structure as disclosed in claim 7, further comprising:

at least one conduit connector defining a conduit ring having an upward extending first ring support and a lower extending second ring support, said conduit ring adapted to retain an object within said conduit ring and retain said object to at least one said vertical stud member by inserting said first and second ring supports in adjacent connector clips along side portions of said at least one vertical stud members.

* * * * *